US008146499B2

(12) United States Patent
Guyvarch et al.

(10) Patent No.: US 8,146,499 B2
(45) Date of Patent: Apr. 3, 2012

(54) METHOD AND SYSTEM FOR ACTIVATING THE CHARGE OF A MUNITION, MUNITION FITTED WITH A HIGH PRECISION ACTIVATION DEVICE AND TARGET NEUTRALISATION SYSTEM

(75) Inventors: Jean-Paul Guyvarch, Igny (FR); Patrick Doignon, Olivet (FR)

(73) Assignee: TDA Armements S.A.S. (FR)

( * ) Notice: Subject to any disclaimer, the term of this patent is extended or adjusted under 35 U.S.C. 154(b) by 190 days.

(21) Appl. No.: 11/572,565

(22) PCT Filed: Jul. 22, 2005

(86) PCT No.: PCT/EP2005/053582

§ 371 (c)(1),
(2), (4) Date: Jan. 23, 2007

(87) PCT Pub. No.: WO2006/010741

PCT Pub. Date: Feb. 2, 2006

(65) Prior Publication Data

US 2007/0193466 A1 Aug. 23, 2007

(30) Foreign Application Priority Data

Jul. 23, 2004 (FR) ..... 04 08188

(51) Int. Cl.
*F42C 99/00* (2006.01)

(52) U.S. Cl. ..... 102/213; 102/501

(58) Field of Classification Search ..... 102/213, 102/214, 211, 201, 501; 244/3.13, 3.16; 235/411, 412, 413
See application file for complete search history.

(56) References Cited

U.S. PATENT DOCUMENTS

| | | | | |
|---|---|---|---|---|
| 4,199,686 | A * | 4/1980 | Brunsting et al. | 250/459.1 |
| 4,269,121 | A * | 5/1981 | Sochard | 102/213 |
| 4,903,602 | A * | 2/1990 | Skagerlund | 102/213 |
| 7,089,865 | B2 * | 8/2006 | Regev | 102/506 |
| 7,143,539 | B2 * | 12/2006 | Cerovic et al. | 42/84 |

FOREIGN PATENT DOCUMENTS

| | | | |
|---|---|---|---|
| FR | 2 747 185 | | 10/1997 |
| GB | 2132740 | A * | 7/1984 |
| WO | 03/106911 | | 12/2003 |

* cited by examiner

*Primary Examiner* — Bret Hayes
*Assistant Examiner* — Reginald Tillman, Jr.
(74) *Attorney, Agent, or Firm* — Lowe Hauptman Ham & Berner, LLP

(57) ABSTRACT

This invention relates to a method and a system for activating a munition charge. It also relates to a munition fitted with a high precision activation device. Finally, it relates to a system for neutralization of a target.

Figure 1:
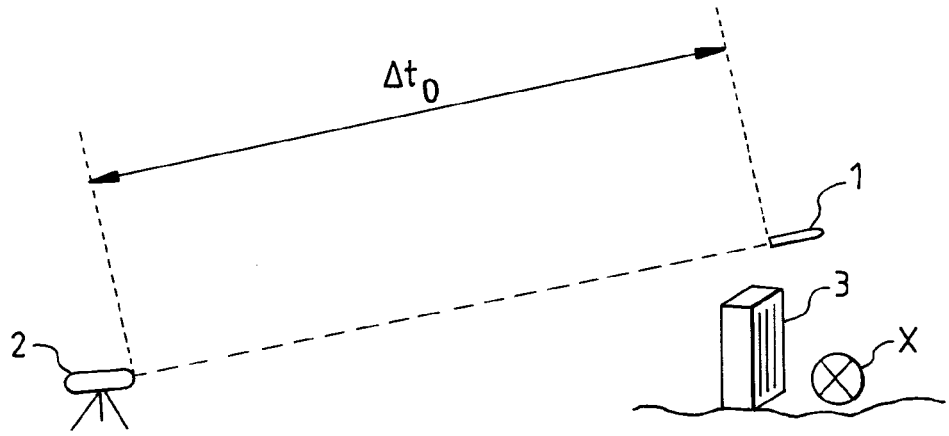

A laser beam (21) is used for illuminating an object (3) located close to the target (X), firing of the charge (23) of the munition being activated using detection by the munition of the laser spot (24) reflected by the object (3). Firing is activated at a time t1 after the time $t_0$ at which the laser spot (24) is detected.

The invention is applicable particularly to hit hidden targets for which a direct impact with these targets is not necessary.

5 Claims, 3 Drawing Sheets

METHOD AND SYSTEM FOR ACTIVATING THE CHARGE OF A MUNITION, MUNITION FITTED WITH A HIGH PRECISION ACTIVATION DEVICE AND TARGET NEUTRALISATION SYSTEM

RELATED APPLICATIONS

The present application is based on International Application No. PCT/EP2005/053582, filed on Jul. 22, 2005, which in turn corresponds to FRANCE Application No. 04 08188 filed on Jul. 23, 204, and priority is hereby claimed under 35 USC §119 based on these applications. Each of these applications are hereby incorporated by reference in their entirety into the present application.

This invention relates to a method and system for activation of the charge in a munition. It also relates to a munition fitted with a high precision activation device. Finally, it relates to a system for neutralisation of a target. The invention is applicable particularly to hit hidden targets for which a direct impact with these targets is not necessary.

Guided or unguided munitions fired from a distance by any type of device, for example a pyrotechnic, electric or pneumatic gun, or various mechanical launchers, may have a direct kinetic effect on the objective. This effect may or may not be lethal depending on the firing conditions and the nature of the projectile (for example metal or rubber). These munitions may also have a reinforced or indirect effect by providing the munition with a secondary device such as:

- a shaped pyrotechnic charge, for explosion or for dispersion of sub-projectiles, liquid or gas, for example a tear gas;
- a charge delivering a secondary typically non lethal effect, for example using a non-pyrotechnic, mechanical or pneumatic means.

For example, applications of indirect effects relate to:

- a medium calibre munition fired by a gun against a building in direct firing in which it would be useful in operations to fire the munition towards the opening of a window and to trigger the charge at the point of entry into the room and not on impact in contact with the wall at the back of the room;
- a munition of the same type as described above but fired against infantrymen ambushed behind any type of obstacle, for example a dwarf wall or sand bags.

The problem with this type of application is application of the secondary device at the right moment. There are several solutions.

It is known that target proximity can be detected by radar or optical type active means, or by magnetic or capacitive influence. However, proximity detection devices are not always satisfactory, for example for targets without a usable electromagnetic or magnetic signature or in complex environments.

It is known that remote control means can be used, for example for sending a radio signal at a precise instant. Such a solution is complex and expensive to implement and is consequently unacceptable.

It is also known that a secondary device can be triggered by an effect purely internal to the munition, for example by timing. Since the velocity of the munition is assumed to be known, a distance traveled can be deduced and therefore a trigger location can be defined. The main disadvantage of this solution is that it is not precise. The precision of the trigger distance is hardly compatible with operational needs. This need is typically for a precision better than a meter for a firing distance of the order of one kilometer. Uncertainties on the dynamics of the munition's movement are such that this precision of 1 in 1000 would seem to be unachievable.

One particular purpose of the invention is to overcome the disadvantages mentioned above, particularly by enabling a sufficiently precise trigger position without complex implementation. To achieve this, the purpose of the invention is a method for activating a munition close to a target using a laser beam that illuminates an object close to the target, firing of the munition charge being activated when the munition detects the laser spot reflected by the object.

Firing is activated at a time $\Delta t\mathbf{1}$ after the time $t_0$ at which the laser spot is detected, and the time $\Delta t\mathbf{1}$ may possibly be approximately zero.

The line of sight of the munition preferably passes close to the object. The object may be an obstacle behind which the target is concealed.

The head of the munition is fitted with at least one optical detector.

The invention also relates to a system for activation of a munition close to a target, the system comprising at least:

- a laser source creating a beam, that illuminates an object close to the target;
- an optical device fitted on the munition to detect the laser spot reflected by the object;
- a control unit fitted on the munition creating the activation signal from a detection signal received by the optical device.

When the laser source is coupled to the gun firing the munition, the sight direction of the gun passes close to the object.

The control unit emits the firing signal at a time $\Delta t\mathbf{1}$, possibly equal to zero, after the detection signal reception time $t_0$.

For example, the optical device comprises optical detectors placed at the periphery of the munition head.

The invention also relates to a munition comprising an activation device composed of at least one optical detector and a control unit, the optical detector being designed to detect a signal produced by an object close to a target.

Preferably, detectors are placed at the periphery of the munition head. Optical detectors may for example be located around the periphery of the same cross section.

Advantageously, the optical aperture of detectors is elliptical, the major axis of the aperture being oriented perpendicular to the axis of symmetry of the munition.

For example, the angle $\alpha$ between the optical axis of a detector and the axis of the munition is equal to approximately 60°.

Advantageously, the optical detector 43 and the control unit are made for example in the form of a kit adaptable to existing munitions to replace a control device originally fitted on the munition.

Finally, the invention relates to a system for neutralisation of a target comprising at least one munition like that described above and a laser source to illuminate an object in the vicinity of the target, firing of the munition charge being activated by the control unit using detection of the laser spot reflected by the object.

Figure 2:
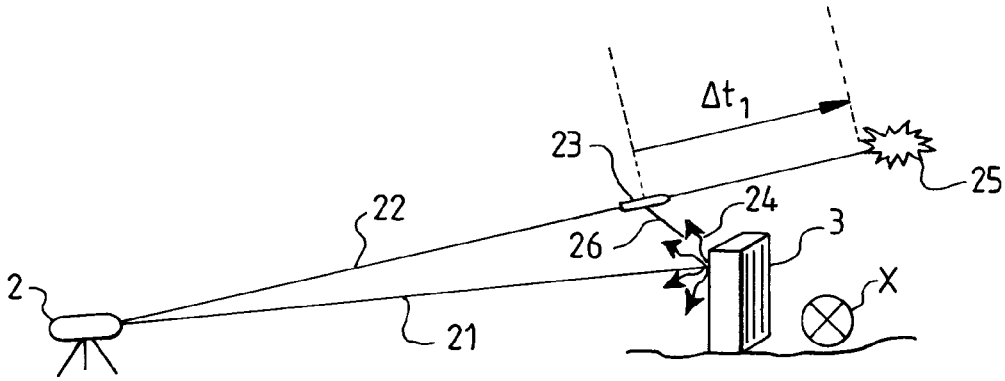
Figure 3:
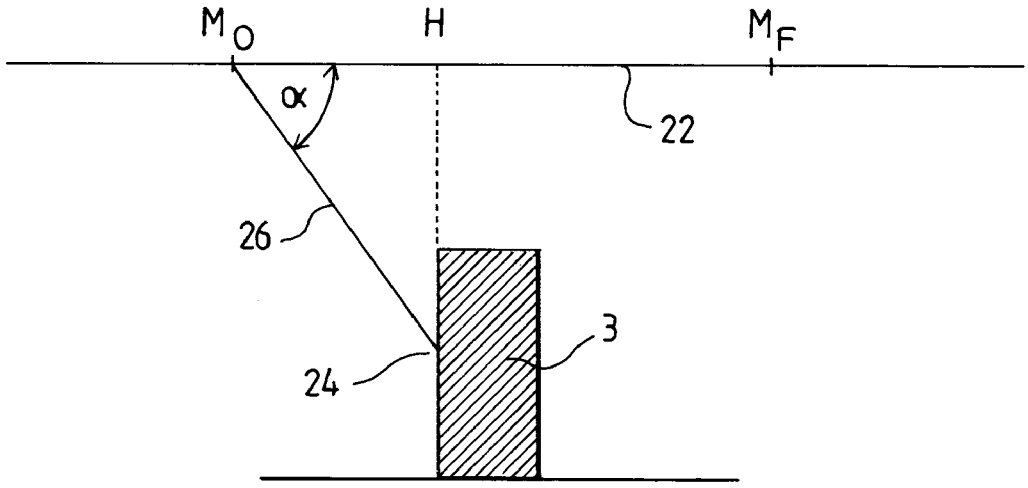
Figure 4:
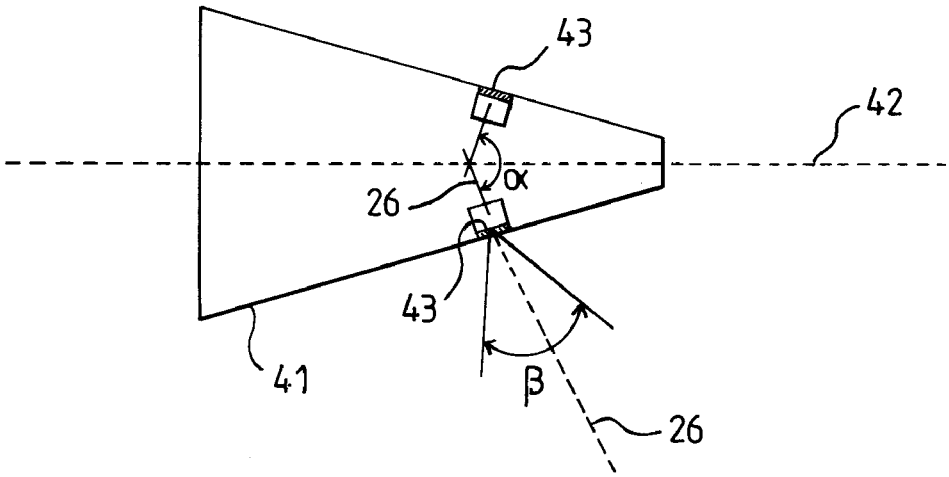
Figure 5:
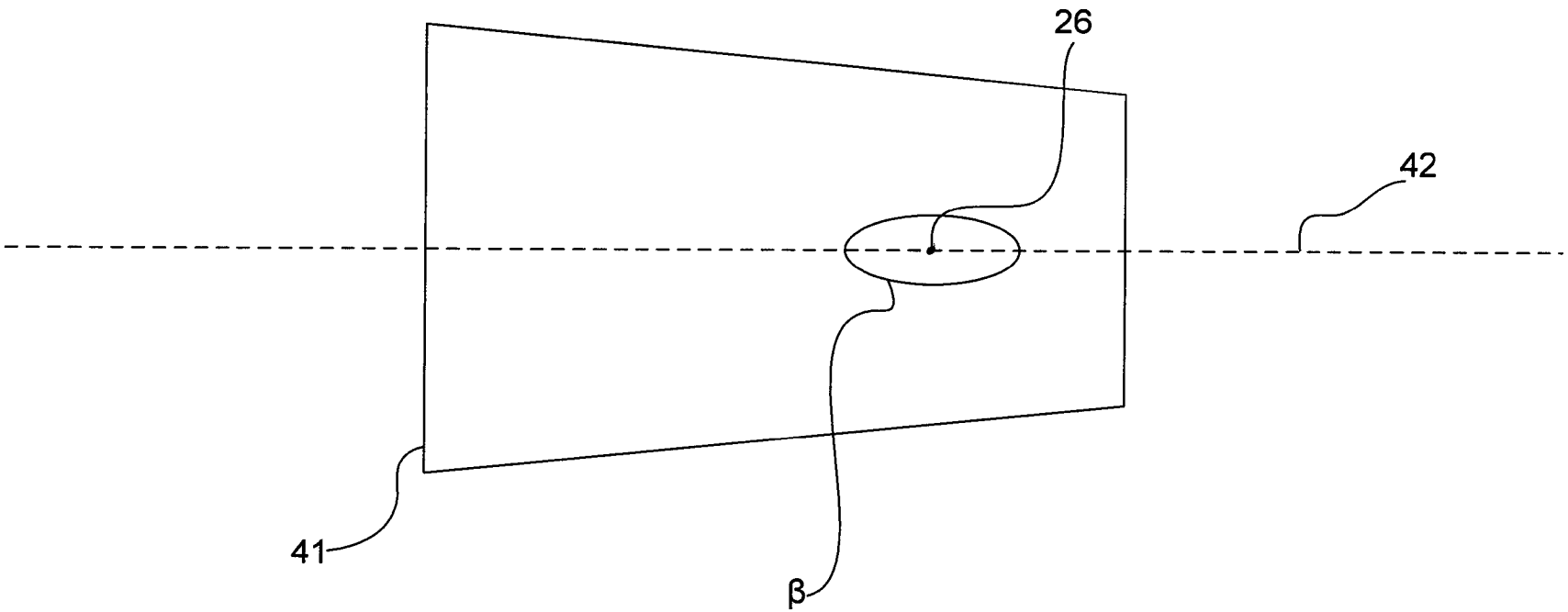

Other characteristics and advantages of the invention will become clear after reading the following description with reference to the attached drawings that represent:

FIG. 1, an example embodiment of the activation of the charge of a munition according to prior art;

FIG. 2, an illustration of the method and a system according to the invention for activation of a munition;

FIG. 3, an illustration of the trajectory of a munition in the vicinity of an object close to a target;

FIG. 4, an illustration of the head of a munition fitted with an activation device according to the invention;

FIG. 5, an illustration of the head of a munition fitted with the activation device according to the invention.

FIG. 1 shows an example embodiment of a system for activation of the charge of a munition according to prior art. A munition 1 is fired from a distance by a gun 2. The purpose of the mission is to neutralise a target X hidden behind an obstacle 3, for example a dwarf wall. The gun 2 is located at about a kilometer from the dwarf wall 3. Knowing the velocity of the munition 1, it is theoretically possible to deduce the distance travelled by the munition at a time Δt after firing. Conversely, knowing the distance D at which the charge in the munition is required to explode, the corresponding time $\Delta t_0$ to elapse before firing can be deduced. However, the velocity of the munition cannot be defined more accurately than 1%. Consequently, for a distance from the target of the order of one kilometer, the precision obtained cannot be better than about ten meters. This precision is not sufficient to neutralise a target hidden behind a dwarf wall or inside a building close to a window.

FIG. 2 shows a method and also a system for activation of the charge of a munition 23 according to the invention. A laser beam 21 is used. This laser beam 21 does not illuminate the target X because the target is hidden, and instead illuminates an object close to it and chosen by the gunner. The object may be the obstacle that hides the target, for example a part of a wall or a dwarf wall 3 behind which the target X is hidden. For example, the chosen object may also be the frame of a window or an opening in a building. The aiming direction 22 of the munition 23 is chosen by the gunner. It passes close to the object 3. For example, it aims at the middle of a window or a location about one meter above a dwarf wall. The laser beam 21 is created by a laser source, for example coupled to the gun 2.

The munition 23 is fitted with a directional optical detector designed to detect the laser spot 24 reflected by the object close to the target X, in fact the dwarf wall 3 in the example in FIG. 2, according to a predefined geometric configuration. When the optical detector fitted on the munition 23 detects the laser spot, in other words when the munition passes close to the dwarf wall 3, a delay in firing Δt1 is triggered. After this time Δt1, the munition is fired and explodes 25. The time Δt1 is very short but is sufficient for the munition 23 to go beyond the obstacle 3 and explode facing the target X close to the target. In this case, the uncertainty on the distance travelled after detection of the laser spot on the obstacle is extremely small because the predefined distance involved is no longer of the order of a kilometer, but is of the order of 10 meters, or even a few meters. In this case, the lack of precision of the distance travelled due for example to an inaccuracy equal to 1% will only be about 0.1 meters.

Therefore at time $t_0$, the optical detector of the munition detects the laser spot 24 and the charge of the munition is fired after a pre-set delay Δt1. Δt1 may be set equal to zero if required. In this case, the delay created is the natural firing delay that is sufficient for the charge to explode a few meters after $t_0$. The munition comprises an optical device to detect the spot. It also comprises a control unit to process detection signals received by the optical device, to create the delay Δt1 if required and to create a signal to activate firing of the munition charge using a received detection signal.

It is assumed that the obstacle 3 is rough, in other words in particular that it comprises surface irregularities with dimensions larger than the laser wavelength, and that it is not completely absorbent, so that the reflected laser signal 24 is not very directional and its intensity is sufficient so that it can be detected at a few meters. These conditions frequently occur in reality and therefore are not very restrictive.

FIG. 3 shows the trajectory of the munition 23, assumed to be coincident with the firing axis 22, and the optical axis 26 of a detector installed on the munition in the vicinity of the obstacle 3, for example a dwarf wall. The two axes 22, 26 form an approximately constant angle α. $M_0$ represents the first point on the trajectory 22 at which the detector detects the laser spot 24 on the obstacle, corresponding to time $t_0$ mentioned above. The spot is located at a point I on the surface of the obstacle. The point H represents the projection of point I on the trajectory 22 of the munition and point $M_F$ is the desired firing point on this same trajectory.

The distance $M_0H$ depends on the overflight height of the munition over the obstacle, the point illuminated on the obstacle and the orientation angle α of the detector, assumed to be known perfectly. It follows that:

$$M_0H=IH/\tan\alpha \quad (1)$$

Consequently, there is an absolute error $\Delta(M_0H)$ given by the following relation:

$$\Delta(M_0H)=\Delta(IH)/\tan\alpha \quad (2)$$

The uncertainty Δ(IH) depends particularly on errors in aiming the laser line of sight and the firing line, the characteristics of the laser spot on the obstacle 3 and characteristics of the onboard detector in the munition 23. The error Δ(IH) for a firing distance of the order of one kilometer may be of the order of 2 meters.

The choice of the angle α is important. This angle α depends on the arrangement of the detector in the munition 23 and more particularly the inclination of its optical axis with respect to the axis of the munition. If α is small, the term 1/tan α becomes very large and tends towards infinity when α tends to 0.

$$\text{for } \alpha=45°: \Delta(M_0H)=\Delta(IH)$$

$$\text{for } \alpha=90°: \Delta(M_0H)=0$$

Therefore, it is advantageous to choose an angle α close to 90°, but there are two disadvantages:

- the reflected laser signal is weaker and more dependent on the surface condition of the obstacle;
- the risk of direct detection of the laser signal before reflection on the obstacle is greater.

A good compromise can be to use an angle α of the order of 60°. In particular, for α=60°: $\Delta(M_0H)=\Delta(IH)/1.73$. This gives a required order of magnitude for $\Delta(M_0H)$.

Starting from point $M_0$ corresponding to time $t_0$, the charge is fired with a delay:

$$\Delta t=M_0M_F/v \quad (3)$$

where v is the velocity of the munition assumed to be known with a negligible relative error compared with the relative error on the distance $M_0M_F$, itself equal to $\Delta(M_0M_F)/M_0M_F$.

FIG. 4 shows the head of a munition according to the invention fitted with a high precision activation device. In other words, such a munition will detonate at a location that can be defined precisely, particularly with a precision like that expressed above. In particular, the activation device comprises optical detectors and an associated electronic processing and control unit.

The munition is composed of a body, not shown, for example containing the pyrotechnic charge and the head 41. Conventionally, the head has an approximately conical shape around the axis of symmetry 42 of the munition that is coincident with the axis of its trajectory during the firing phase. The head 41 of the munition comprises an optical device that in particular will detect the laser spot reflected by an obstacle 3. This optical device comprises optical detectors 43 placed around the periphery of the head 41 of the munition. For example, the optical detectors are infrared detectors. The angle formed between the optical axis 26 of a detector 43 and the axis 42 of the munition is denoted as $\alpha$. In accordance with what has been described above, the angle $\alpha$ may for example be of the order of 60°. The field of the optical lens is a parameter to be adjusted as a function of the mission characteristics. A typical order of magnitude is an aperture $\beta$=15°. This aperture may be circular or advantageously elliptical, particularly as described below.

For example, the optical detectors are arranged on a single cross section of the head and are distributed around the periphery of this section. They may be distributed uniformly, with a sufficiently large number to cover the entire space and more particularly to take account of the roll of the munition. The position of the munition in roll is not usually known. Several detectors then have to be distributed around the periphery of the head, preferably on the same cross section. These detectors may be distributed uniformly and symmetrically about the axis 42 of the munition. It is advantageous to use optics with an asymmetric aperture, for example including a wide field in the plane perpendicular to FIG. 4 passing through the optical axis 26, so as to limit the number of detectors, particularly for cost reasons. As shown in FIG. 5, the aperture $\beta$ of a detector is then elliptical, with the major axis 26 being oriented perpendicular to the axis of symmetry 42 of the munition. However, the optical field in this direction must not be too large to avoid reducing the precision. Under these conditions, the number of detectors can be limited to 3 or 4.

If the munition is stabilised by the gyroscopic effect, in other words by self-rotation about its axis 42, the device with several detectors is also useful to reduce uncertainty on the detection time. For medium calibre artillery munitions, for example 40 millimeters, this rotation velocity can typically be equal to or greater than 1000 turns per second. Two detectors may be sufficient under these conditions.

The head also comprises an electronic unit designed particularly to process optical signals output by detectors and then to create the munition charge firing activation signal, possibly with a delay t1. The electronic unit is connected to the optical detectors for this purpose.

A munition for which the head is shown in FIG. 3 may be used in a system significantly different from that shown in FIG. 2, provided that it can detect a signal, for example a laser spot, located close to a target. Such a munition associated with a laser source forms a system for effective neutralisation of a target.

Advantageously, the optical detector 43 and the control unit are made for example in the form of a kit adaptable to existing munitions to replace a control device that was originally used in the munition, for example to replace an electronic time fuse or an impact detector. The old control device is then taken out, for example by unscrewing, and replaced by the adaptable kit.

The invention claimed is:

1. A method for activating a munition close to a target, comprising the steps of:

illuminating an object close to the target using a laser beam created by a laser source provided separately from the munition; and firing of the munition being activated when the munition detects a laser spot reflected by the object, wherein the object is an obstacle behind which the target is hidden.

2. The method according to claim 1, wherein said firing is activated at a time t1 after a detection signal reception time $t_0$ and at which the laser spot is detected.

3. The method according to claim 2, wherein the time t1 is substantially equal to zero.

4. The method according to claim 1, wherein a sight direction of the munition passes close to the object.

5. The method according to claim 1, wherein the munition has a head which is fitted with at least one optical detector.

* * * * *